US010366816B2

(12) United States Patent
Yamashita et al.

(10) Patent No.: US 10,366,816 B2
(45) Date of Patent: Jul. 30, 2019

(54) SOLENOID DRIVE DEVICE

(71) Applicant: HONDA MOTOR CO., LTD., Tokyo (JP)

(72) Inventors: Hideaki Yamashita, Wako (JP); Yasumasa Kaitani, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 252 days.

(21) Appl. No.: 15/592,209

(22) Filed: May 11, 2017

(65) Prior Publication Data

US 2017/0338019 A1 Nov. 23, 2017

(30) Foreign Application Priority Data

May 23, 2016 (JP) ..... 2016-102286

(51) Int. Cl.
*H01F 7/06* (2006.01)
*H01F 7/18* (2006.01)

(52) U.S. Cl.
CPC ..... *H01F 7/064* (2013.01); *H01F 7/1844* (2013.01); *H01F 7/1877* (2013.01); *H01F 2007/1888* (2013.01)

(58) Field of Classification Search
CPC ..... H01F 7/064; H01F 7/1844; H01F 7/1877; H01F 2007/1888
USPC ..... 361/167
See application file for complete search history.

(56) References Cited

U.S. PATENT DOCUMENTS 6,249,418 B1 * 6/2001 Bergstrom ..... F01L 9/04 361/152
7,099,136 B2 * 8/2006 Seale ..... F01L 9/04 123/90.11

FOREIGN PATENT DOCUMENTS

JP 2003-068525 3/2003
JP 2015179780 A * 10/2015

OTHER PUBLICATIONS

Machine Translation of Takahashi et al. Japanese Patent Document JP 2015-179780 A Oct. 8, 2015 (Year: 2015).*
Machine Translation of Honda et al. Japanese Patent Document JP 2003-068525 A Mar. 7, 2003 (Year: 2003).*

* cited by examiner

*Primary Examiner* — Kevin J Comber
(74) *Attorney, Agent, or Firm* — Mori & Ward, LLP

(57) ABSTRACT

A solenoid drive device includes a first solenoid drive circuit, a second solenoid drive circuit, a selection circuit, and circuitry. The circuitry controls the first switching element and the second switching element with a duty control in a control cycle according to acquired values of the first drive current and the second drive current so that a first on/off switching direction of the first switching element at a start timing of the control cycle is opposite to a second on/off switching direction of the second switching element at the start timing. The circuitry determines whether a failure in at least one of the selector, the first solenoid drive circuit, and the second solenoid drive circuit occurs based on a change in the selection detection signal in a period during which an on/off state of the first switching element is different form an on/off state of the second switching element.

6 Claims, 5 Drawing Sheets

SOLENOID DRIVE DEVICE

CROSS-REFERENCE TO RELATED APPLICATIONS

The present application claims priority under 35 U.S.C. § 119 to Japanese Patent Application No. 2016-102286, filed May 23, 2016, entitled "Solenoid Drive Device." The contents of this application are incorporated herein by reference in their entirety.

BACKGROUND

1. Field

The present disclosure relates to a solenoid drive device.

2. Description of the Related Art

Japanese Unexamined Patent Application Publication No. 2003-68525 discloses a current detection device in which voltages across a plurality of current detection resistors respectively coupled to a plurality of solenoids are inputted into one A/D converter via a multiplexer, and a value of current flowing in the plurality of solenoids is detected.

SUMMARY

According to one aspect of the present invention, a solenoid drive device includes a first solenoid drive circuit, a second solenoid drive circuit, and a control element. The first solenoid drive circuit includes a first solenoid, a first switching element configured to perform duty control of an application voltage of the first solenoid, and a first current detection element configured to detect a first drive current supplied to the first solenoid. The second solenoid drive circuit includes a second solenoid, a second switching element configured to perform duty control of an application voltage of the second solenoid, and a second current detection element configured to detect a second drive current supplied to the second solenoid. The control element is configured to change the first drive current and the second drive current by performing on/off duty control of the first switching element and the second switching element. The solenoid drive device includes a selection circuit configured to select either one of a first current detection signal outputted from the first current detection element and a second current detection signal outputted from the second current detection element. The control element includes a duty control element configured to supply a selection command signal selecting either one of the first current detection signal and the second current detection signal to the selection circuit, acquire values of the first drive current and the second drive current based on a selection detection signal outputted from the selection circuit, and perform the on/off duty control depending on the acquired values of the first drive current and the second drive current. The control element includes a failure determination element is configured to perform failure determination with the selection circuit, the first solenoid drive circuit, and the second solenoid drive circuit as determination targets based on change characteristics of the selection detection signal. The duty control element performs the on/off duty control of the first switching element in the same control cycle as on/off duty control of the second switching element, and sets on/off switching direction of the first switching element at a start time of one control cycle and on/off switching direction of the second switching element reversely from each other, the on/off switching direction including a switching direction from on to off and a switching direction from off to on. The failure determination element performs the failure determination based on change characteristics of the selection detection signal in a specified period when on/off states of the first switching element and the second switching element are different from each other.

According to another aspect of the present invention, a solenoid drive device includes a first solenoid drive circuit, a second solenoid drive circuit, a selection circuit, and circuitry. The first solenoid drive circuit includes a first solenoid, a first switching element, and a first current detection element. The first switching element controls a first application voltage applied to the first solenoid. The first current detection element detects a first drive current supplied to the first solenoid and outputs a first current detection signal. The second solenoid drive circuit includes a second solenoid, a second switching element, and a second current detection element. The second switching element controls a second application voltage applied to the second solenoid. The second current detection element detects a second drive current supplied to the second solenoid and outputs a second current detection signal. The selection circuit is connected to the first current detection element and the second current detection element. The circuitry is configured to output a selection command signal to the selection circuit to select either one of the first current detection signal and the second current detection signal so as to output a selection detection signal. The circuitry is configured to acquire values of the first drive current and the second drive current based on the selection detection signal. The circuitry is configured to control the first switching element and the second switching element with a duty control to control the first drive current and the second drive current in a control cycle according to the acquired values of the first drive current and the second drive current so that a first on/off switching direction of the first switching element at a start timing of the control cycle is opposite to a second on/off switching direction of the second switching element at the start timing. The first on/off switching direction and the second on/off switching direction include a switching direction from on to off and a switching direction from off to on. The circuitry is configured to determine whether a failure in at least one of the selector, the first solenoid drive circuit, and the second solenoid drive circuit occurs based on a change in the selection detection signal in a period during which an on/off state of the first switching element is different form an on/off state of the second switching element.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE PREFERRED EMBODIMENTS

Figure 1:
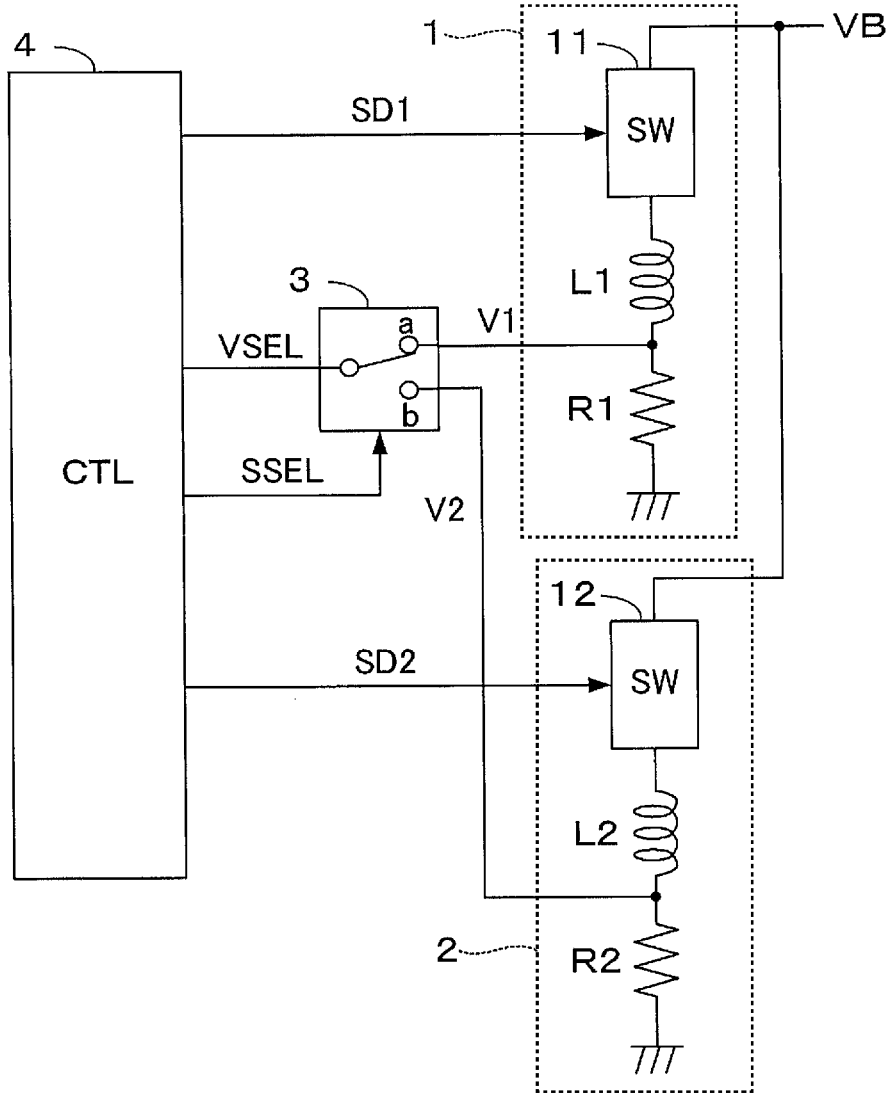
FIG. 1 is a diagram illustrating a configuration of a solenoid drive device according to one embodiment of the present disclosure.

The embodiments will now be described with reference to the accompanying drawings, wherein like reference numerals designate corresponding or identical elements throughout the various drawings.

Hereinafter, embodiments of the present disclosure are described with reference to the accompanying drawings.

FIG. 1 is a diagram illustrating a configuration of a solenoid drive device according to one embodiment of the present disclosure. The solenoid drive device includes a first solenoid drive circuit 1 that includes a first solenoid L1, a first switching circuit 11, and a first resistor R1, a second solenoid drive circuit 2 that includes a second solenoid L2, a second switching circuit 12, and a second resistor R2, a selection circuit 3, and a control unit 4. A battery voltage VB is supplied to one end of the first switching circuit 11, and another end of the first switching circuit 11 is coupled to the ground via the first solenoid L1 and the first resistor R1. A battery voltage VB is supplied to one end of the second switching circuit 12, and another end of the second switching circuit 12 is coupled to the ground via the second solenoid L2 and the second resistor R2. The first and second switching circuits 11, 12 include, for example, a field effect transistor (switching element) only or a circuit using a transistor and a diode in combination. This circuit is described in, for example, Japanese Unexamined Patent Application Publication No. 2003-68525, the entire contents of which are incorporated herein by reference.

Voltage (hereinafter referred to as "first voltage") V1 at a connecting point between the first solenoid L1 and the first resistor R1 is supplied to a terminal a of the selection circuit 3, and voltage (hereinafter referred to "second voltage") V2 at a connecting point between the second solenoid L2 and the second resistor R2 is supplied to a terminal b of the selection circuit 3. The selection circuit 3 is configured to select either one of terminals a and b according to a selection command signal SSEL supplied from the control unit 4 and supply the first voltage V1 or the second voltage V2 to the control unit 4. Specifically, when the selection command signal SSEL is at a high level, the terminal a is selected, and the first voltage V1 is supplied to the control unit 4. On the other hand, when the selection command signal SSEL is at a low level, the terminal b is selected, and the second voltage V2 is supplied to the control unit 4.

The control unit 4 includes an AD conversion circuit, a memory, a central processing unit (CPU), and so on. The control unit 4 is configured to acquire a first drive current ISOL1 (=V1/r1, where r1 is a resistance value of the resistor R1) supplied to the first solenoid L1 with the first voltage V1 and acquire a second drive current ISOL2 (=V2/r2, where r2 is a resistance value of the resistor R2) supplied to the second solenoid L2 with the second voltage V2. The control unit 4 is configured to supply a first drive signal SD1 controlling on/off duty of the first switching circuit 11 to the first switching circuit 11 such that the average value of acquired first drive currents IOSL1 matches a target value and supply a second drive signal SD2 controlling on/off duty of the second switching circuit 12 to the second switching circuit 12 such that the average value of acquired second drive currents ISOL2 matches a target value. The control unit 4 is further configured to perform a failure determination processing described below and determine a failure of the first and second solenoid drive circuits 1, 2 and the selection circuit 3.

Figures 2A, 2B, 2C, 2D, 2E:
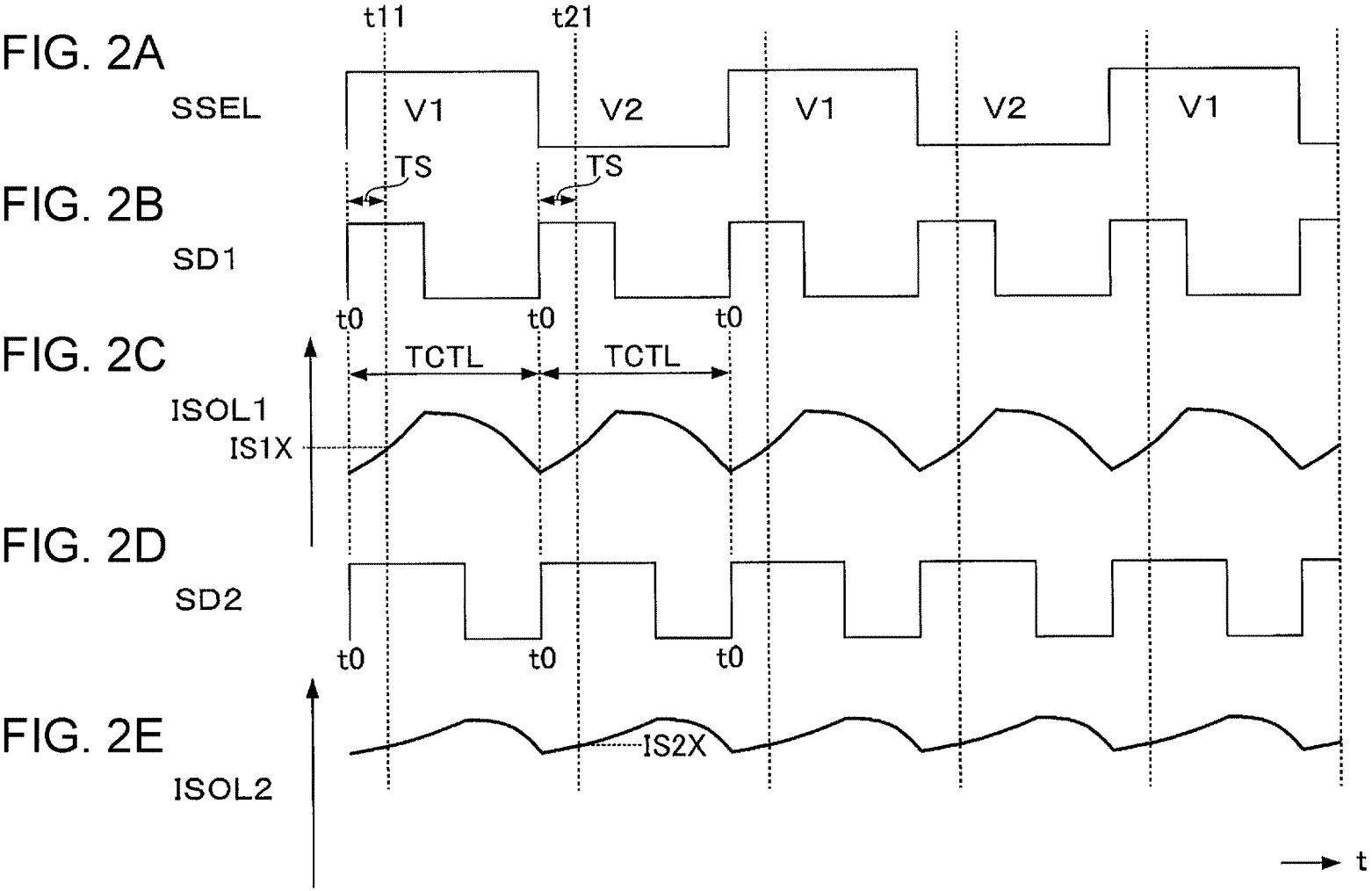
FIGS. 2A to 2E are time charts for illustrating an example of performing failure determination of first and second solenoid drive circuits without performing failure determination of the selection circuit.
Figure 3:
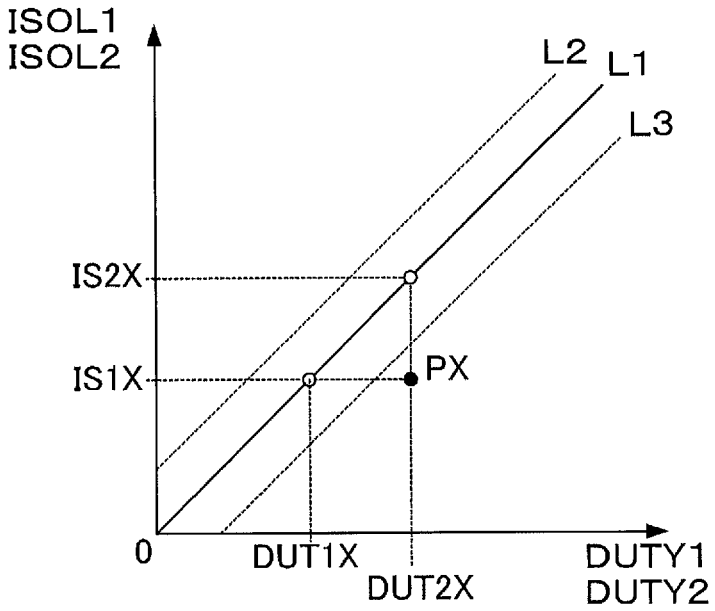
FIG. 3 is a diagram for illustrating a problem in the example illustrated in FIG. 2A to 2E.

FIGS. 2A to 3 are diagrams for illustrating problems when performing a failure determination of the first and second solenoid drive circuits 1, 2 based on a signal (either one out of the first voltage V1 and the second voltage V2, and hereinafter referred to as "selection detection signal VSEL") selected by the selection circuit 3 but without performing a failure determination of the selection circuit 3.

FIGS. 2A to 2E are time charts respectively illustrating a transition of the selection command signal SSEL, first drive signal SD1, first drive current ISOL1, second drive signal SD2, and second drive current ISOL2 in a state where both the first and second solenoid drive circuits 1, 2 are normal. In a state where the duty ratio of the drive signals SD1 and SD2 is constant, a first current detection value IS1X is acquired by sampling the first drive current ISOL1 at a time t11, and a second current detection value IS2X is acquired by sampling the second drive current ISOL2 at a time t21. Sampling times t11, t12 are set to timings elapsed by a predetermined time TS after a start time t0 of the control cycle TCTL of the drive signals SD1, SD2.

FIG. 3 is a diagram illustrating a relationship between duty ratios DUTY1, DUTY2 of the drive signals SD1, SD2 and the drive currents ISOL1, ISOL2. When all of the selection circuit 3 and first and second solenoid drive circuits 1, 2 are normal, the first and second current detection values IS1X, IS2X are within a normal range defined by broken lines L2 and L3 with a straight line L1 as a center. When the first current detection value IS1X or the second current detection value IS2X is outside the normal range, it is determined that the first solenoid drive circuit 1 or second solenoid drive circuit 2 has a failure (disconnection, or on-failure keeping the switching circuits 11, 12 turned on). However, this determination is made on assumption that the selection circuit 3 is normal. In FIG. 3, the duty ratio DUTY1 of the first drive signal SD1 illustrated in FIG. 2B is indicated as DUT1X, and the duty ratio DUTY2 of the second drive signal SD2 is indicated as DUT2X.

For example, in a case where a sticking failure occurs when the selection circuit 3 selects the terminal a, the selection detection signal VSEL outputted from the selection circuit 3 at a time t21 turns the first voltage V1, the current detection value turns the first current detection value IS1X, and an operating point PX indicated in FIG. 3 moves to the outside of the normal range. Thus, this leads to an erroneous determination that the second solenoid drive circuit 2 has a failure.

In the present embodiment, sticking of the selection circuit 3 and failure (disconnection, or on-failure keeping switching circuits 11, 12 turned on) of the first solenoid drive circuit 1 or second solenoid drive circuit 2 may be determined by discriminating these failures from each other by a failure determination method described below.

Figures 4A, 4B, 4C, 4D, 4E:
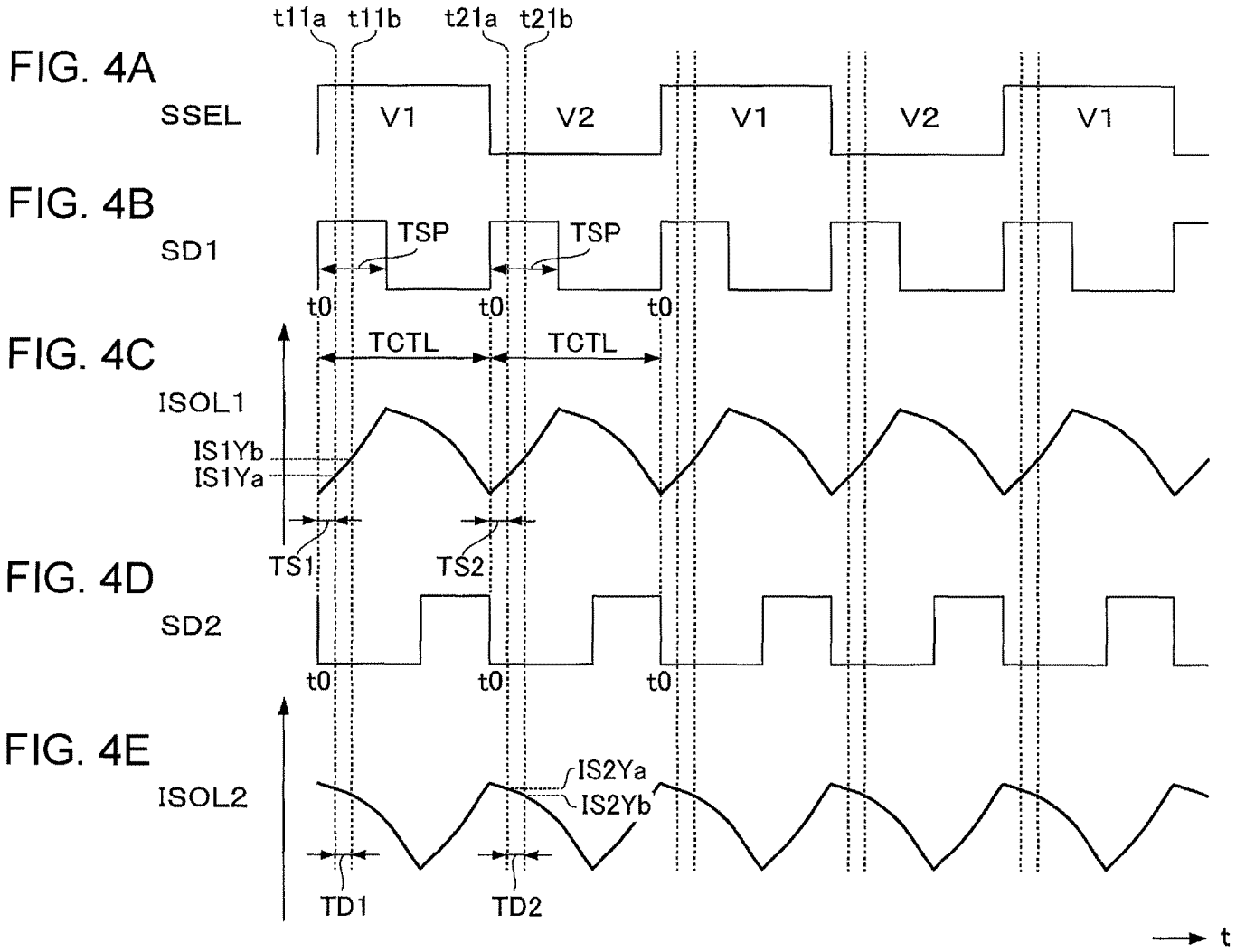
FIGS. 4A to 4E are time charts illustrating an operation example for illustrating a failure determination method of the present disclosure.

FIG. 4 is a time chart for illustrating a failure determination method of the present embodiment. FIGS. 4A to 4E respectively indicate a transition of the selection command signal SSEL, first drive signal SD1, first drive current ISOL1, second drive signal SD2, and second drive current ISOL2 in a state where both the first and second solenoid drive circuits 1, 4 are normal. In the present embodiment, two sampling times t11*a* and t11*b* for the first drive current ISOL1 and two sampling times t21*a* and t21*b* for the second drive current ISOL2 are set in one control cycle TCTL, and failure determination is performed based on change characteristics of detection current values IS1Ya, IS1Yb, IS2Ya, and IS2Yb acquired at the two sampling times. FIGS. 4C and 4E illustrate current variation waveforms enlarged in the vertical direction for easy understanding.

Conditions for performing the failure determination are Conditions 1 to 3 given below:

Condition 1: The control cycle TCTL of the first drive signal SD1 and second drive signal SD2 is the same, and at the start time t0 of the control cycle TCTL, the first switching circuit 11 is switched from off to on, and the second switching circuit 12 is switched from on to off.

Condition 2: Sampling times t11*a*, t11*b*, t21*a*, and t21*b* are set within a specified period TSP when the first switching circuit 11 is in the on state, and the second switching circuit 12 is in the off state.

The sampling time t11*a* of the first drive current ISOL1 is set at a time elapsed by a time TS1 from the start time t0 of the control cycle TCTL, and the sampling time t21*a* of the second drive current ISOL2 is set at a time elapsed by a time TS2 from the start time t0 of the sampling time t21*a*. Further, an interval between times t11*a* and t11*b* is set to a time TD1, and an interval between sampling times t21*a* and t21*b* is set to a time TD2. In the illustrated example, times TS1 and TS2 are the same with each other, and also times TD1 and TD2 are the same with each other. However, those times may be different from each other.

Condition 3: When duty ratios DUTY1, DUTY2 of drive signals SD1, SD2 are "0" or close to "100%", variation of drive currents ISOL1, ISOL2 becomes so small that a failure may not be determined, or determination accuracy decreases. Therefore, failure determination is performed when duty ratios DUTY1, DUTY2 are in a range, for example, between 30% and 70%.

Figure 5:
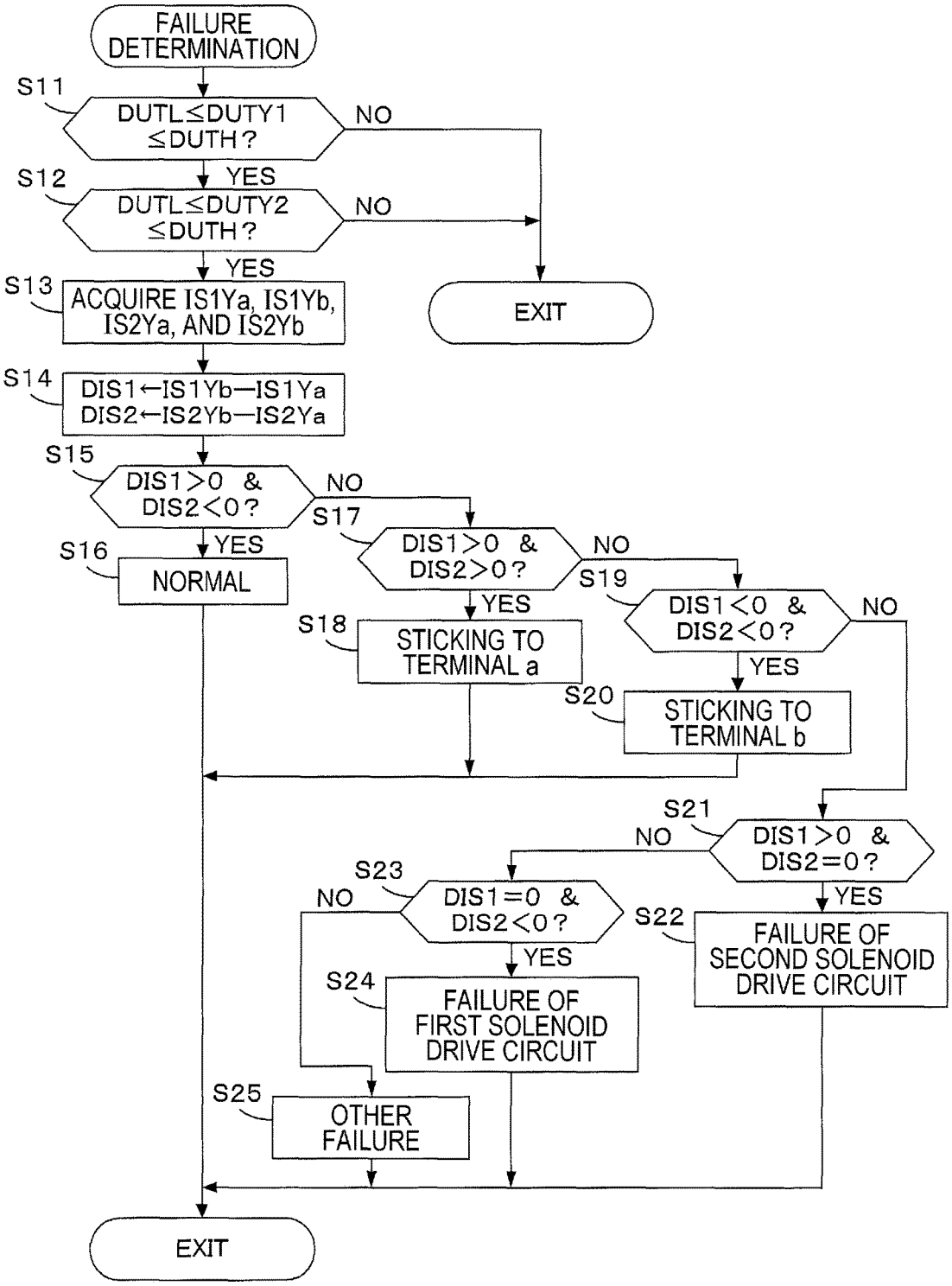
FIG. 5 is a flowchart for illustrating a failure determination method in the operation example illustrated in FIGS. 4A to 4E.

FIG. 5 is a flowchart for illustrating the failure determination method. In steps S11 and S12, the condition 3 that duty ratios DUTY1, DUTY2 are larger than a lower limit value DUTL (for example, 30%) and smaller than an upper limit value DUTH is determined.

When answer in the step S12 is affirmative (YES) and the condition 3 is satisfied, detection current values IS1Ya, IS1Yb, IS2Ya, IS2Yb illustrated in FIGS. 4A to 4E are acquired (step S13), a difference DIS1 (=IS1Yb−IS1Ya) between the first detection current value IS1Y1 at the time t11*a* and the first detection current value IS1Yb at the time t11*b* is calculated, and a difference DIS2 (=IS2Yb−IS2Ya) between the second detection current value IS2Y1 at the time t21*a* and the second detection current value IS2Yb at the time t21*b* is calculated (step S14). Hereinafter, DIS1 is referred to as "first difference", and DIS2 is referred to as "second difference".

In the step S15, it is determined whether the first difference DIS1 is larger than "0" and the second difference DIS2 is smaller than "0". When answer is affirmative (YES), it corresponds to the normal state illustrated in FIGS. 4A to 4E, and the selection circuit 3 and the first and second solenoid drive circuits 1, 2 are determined to be normal (step S16).

When answer in the step S15 is negative (NO), it is determined whether both the first difference DIS1 and the second difference DIS2 are larger than "0" (step S17). When answer in the step S17 is affirmative (YES), it is determined that a failure that the selection circuit 3 sticks to the terminal occurs (step S18). This is because the selection detection signal VSEL becomes the first voltage V1 when a failure that the selection circuit 3 sticks to the terminal occurs, even if the selection command signal SSEL is at a low level.

When answer in the step S17 is negative (NO), it is determined whether both the first difference DIS1 and the second difference DIS2 are smaller than "0" (step S19). When answer in the step S19 is affirmative (YES), it is determined that a failure that the selection circuit 3 sticks to the terminal b occurs (step S20). This is because the selection detection signal VSEL becomes the second voltage V2 when a failure that the selection circuit 3 sticks to the terminal b occurs, even if the selection command signal SSEL is at a high level.

When answer in the step S19 is negative (NO), it is determined whether the first difference DIS1 is larger than "0" and the second difference DIS2 is "0" (step S21). When answer in the step S21 is affirmative (YES), it is determined that a failure occurs in the second solenoid drive circuit 2 (step S22).

When answer in the step S21 is negative (NO), it is determined whether the first difference DIS1 is "0" and the second difference DIS2 is smaller than "0" (step S23). When answer in the step S23 is affirmative (YES), it is determined that a failure occurs in the first solenoid drive circuit 1 (step S24).

When answer in the step S23 is negative (NO), that is, when both the first difference DSI1 and the second difference DSI2 are "0", it is determined that a failure other than the above failures occurs (step S25). Failures other than the above failures may include a failure that occurs in the first solenoid drive circuit 1 and the second solenoid drive circuit 2, a failure that occurs in the first solenoid drive circuit 1 due to sticking of the selection circuit 3 to the terminal a, and a failure that occurs in the second solenoid drive circuit 2 due to sticking of the selection circuit 3 to the terminal b.

Thus, in the present embodiment, on/off duty control of the first switching circuit 11 is performed in the same control cycle TCTL as the on/off duty control of the second switching circuit 12, on/off switching direction of the first switching circuit 11 at the start time t0 of the control cycle TCTL is reverse to on/off switching direction of the second switching circuit 12, and failure determination of the determination target or the first and second solenoid drive circuits 1, 2 and the selection circuit 3 is performed based on change characteristics of the first and second drive currents ISOL1, ISOL2 acquired from the selection detection signal VSEL in the specified period TSP when on/off states of the first and second switching circuits 11, 12 are different from each other. In the specified period TSP when on/off states of the first and second switching circuits 11, 12 are different from each other, for example, when the first switching circuit 11 is in the on state and the second switching circuit 12 is in the off state, the first drive current ISOL1 increases and the second drive current ISOL2 decreases, if the determination target is normal. Therefore, it can be said that if this on and off state is detected, the determination target may be determined to be normal. Also, for example, when a change direction (increase or decrease) of the selection detection signal VSEL in a state where the selection command signal SSEL selecting the terminal a is supplied to the selection circuit 3, and a change direction of the selection detection signal VSEL in a state where the selection command signal SSEL selecting the terminal b is supplied to the selection circuit 3 are the same with each other in the specified period TSP, it may be determined that the selection circuit 3 sticks to the terminal a or terminal b. Further, for example, when there is a change of the selection detection signal VSEL in a state where the selection command signal SSEL selecting the terminal a is supplied to the selection circuit 3, and there is no change of the selection detection signal VSEL in a state where the selection command signal SSEL selecting the terminal b is supplied to the selection circuit 3, it may be determined that there is a failure with a drive current value of the second solenoid drive circuit 2. Therefore, a failure (sticking) of the selection circuit 3 and a failure of drive current (failure of the solenoid drive circuits 1, 2) may be determined by discriminating these failures from each other without adding a failure determination circuit.

Specifically, when the selection detection signal VSEL changes in a first direction (for example, increase direction) during the specified period TSP in a state where the selection command signal SSEL selecting either one (for example, terminal a) out of terminals a and b is supplied to the selection circuit 3, and the selection detection signal VSEL changes in a second direction (for example, decrease direction) reverse to the first direction during the specified period TSP in a state where the selection command signal SSEL selecting the other terminal out of terminals a and b is outputted, the determination target is determined to be normal. When the selection detection signal VSEL changes in the first direction (for example, increase direction), it is determined that the selection circuit 3 sticks to one side selected (for example, to the side of the terminal a). Therefore, a failure of sticking to the terminal a and a failure of sticking to the terminal b may be determined by discriminating these failures from each other.

Further, when there is a change of the selection detection signal VSEL in the first direction (for example, increase direction) during the specified period TSP in a state where the selection command signal SSEL selecting either one (for example, terminal a) out of terminals a and b is outputted, and there is no change of the selection detection signal VSEL in a state where the selection command signal SSEL selecting the other one (for example, terminal b) out of terminals a and b is outputted, it is determined that there is a failure with a solenoid drive circuit corresponding to the other terminal (for example, terminal b). Therefore, a failure of the first solenoid drive circuit 1 and a failure of the second solenoid drive circuit 2 may be determined by discriminating these failures from each other.

In the present embodiment, each of the first and second switching circuits includes first and second switching elements, and the control unit 4 constitutes a control element, a duty control element, and a failure determination element.

The solenoid drive device illustrated in FIG. 1 is applied to, for example, a valve operating phase variable mechanism that continuously changes the operating phase of the intake valve and exhaust valve of the internal combustion engine. However, the present disclosure may be applied to various solenoid drive devices having the basic configuration illustrated in FIG. 1.

The present disclosure is not limited to the embodiments described above, but various modifications are available. For example, in the embodiments described above, sampling times t11*a*, t11*b* of the first drive current ISOL1 are set within a specified period TSTP when the first switching circuit 11 is in the on state, and sampling times t21*a*, t21*b* of the second drive current ISOL2 are set within a specified period TSTP when the second switching circuit 12 is in the off state. However, reversely, sampling times t11*a*, t11*b* of the first drive current ISOL1 may be set within the specified period TSTP in a state where the first switching circuit 11 is in the off state, and sampling times t21*a*, t21*b* of the second drive current ISOL2 may be set within the specified period TSTP in a state where the second switching circuit 12 is in the on state. In this case, all inequality signs of steps S15, S17, S19, S21 and S23 in FIG. 5 are directed reversely.

A first aspect of the present disclosure describes a solenoid drive device including a first solenoid drive circuit including a first solenoid, a first switching element configured to perform duty control of an application voltage of the first solenoid, and a first current detection element configured to detect a first drive current supplied to the first solenoid, a second solenoid drive circuit including a second solenoid, a second switching element configured to perform duty control of an application voltage of the second solenoid, and a second current detection element configured to detect a second drive current supplied to the second solenoid, and a control element configured to change the first drive current and the second drive current by performing on/off duty control of the first switching element and the second switching element, and a selection circuit configured to select either one of a first current detection signal outputted from the first current detection element and a second current detection signal outputted from the second current detection element. Here, the control element includes a duty control element configured to supply a selection command signal selecting either one of the first current detection signal and the second current detection signal to the selection circuit, acquire values of the first drive current and the second drive current based on a selection detection signal outputted from the selection circuit, and perform the on/off duty control depending on the acquired values of the first drive current and the second drive current, and a failure determination element configured to perform failure determination with the selection circuit, the first solenoid drive circuit, and the second solenoid drive circuit as determination targets based on change characteristics of the selection detection signal. Here, the duty control element performs the on/off duty control of the first switching element in the same control cycle as on/off duty control of the second switching element, and sets on/off switching direction of the first switching element at a start time of one control cycle and on/off switching direction of the second switching element reversely from each other, the on/off switching direction including a switching direction from on to off and a switching direction from off to on. Here, the failure determination element performs the failure determination based on change characteristics of the selection detection signal in a specified period when on/off states of the first switching element and the second switching element are different from each other.

With such a configuration, a selection command signal selecting one out of the first and second current detection signals is supplied to a selection circuit, values of the first and second drive currents are acquired based on a selection detection signal outputted from the selection circuit, on/off duty control of first and second switching elements is performed according to the values of the acquired first and second drive currents, and failure determination is performed with the selection circuit, the first solenoid drive circuit, and the second solenoid drive circuit as determination targets based on change characteristics of the selection detection signal. Specifically, on/off duty control of the first switching element is performed in the same control cycle as on/off duty of the second switching element, on/off switching direction of the first switching element at a start time of one control cycle is reverse to on/off switching direction of the second switching element, and failure determination is performed based on change characteristics of the selection detection signal in a specified period when on/off states of the first and second switching elements are different from each other. In the specified period when on/off states of the first and second switching elements are different from each other, for example, when the first switching element is in the on state and the second switching element is in the off state, the first current detection signal increases and the second current detection signal decreases, if the determination target is normal. Therefore, it can be said that if this on and off state is detected, the determination target may be determined to be normal. Also, for example, when a change direction (increase or decrease) of the selection detection signal in a state where the selection command signal selecting the first current detection signal is supplied to the selection circuit, and a change direction of the selection detection signal in a state where the selection command signal selecting the second current detection signal is supplied to the selection circuit are the same with each other in the specified period, the selection circuit may be determined to be sticking. Further, for example, when there is a change of the selection detection signal in a state where the selection command signal selecting the first current detection signal is supplied to the selection circuit, and there is no change of the selection detection signal in a state where the selection command signal selecting the second current detection signal is supplied to the selection circuit, it may be determined that there is a failure with a drive current value of the second solenoid drive circuit. Therefore, a failure (sticking) of the selection circuit and a failure of the solenoid drive circuit (drive current) may be determined by discriminating these failures from each other without adding a failure determination circuit.

In a second aspect of the present disclosure according to the first aspect of the present disclosure, when the selection detection signal changes in a first direction within the specified period in a state where a selection command signal selecting one out of the first current detection signal and the second current detection signal is outputted, the failure determination element, determines that the determination target is normal when the selection detection signal changes in a second direction reverse to the first direction within the specified period in a state where a selection command signal selecting the other one out of the first current detection signal and the second current detection signal is outputted, and determines that the selection circuit sticks to the one when the selection detection signal changes in the first direction.

With such a configuration, when the selection detection signal changes in the first direction during the specified period in a state where the selection command signal selecting one out of the first and second current detection signals is outputted, the determination target is determined to be normal when the selection detection signal changes in the second direction reverse to the first direction during the specified period in a state where the selection command signal selecting the other one out of the first and second current detection signals is outputted. When the selection detection signal changes in the first direction, it is determined that the selection circuit sticks to the one selection side. Therefore, a failure of sticking to a side selecting the first current detection signal and a failure of sticking to a side selecting the second current detection signal may be determined by discriminating these failures from each other.

In a third aspect of the present disclosure according to the first or second aspect of the present disclosure, when the selection detection signal changes in a first direction within the specified period in a state where a selection command signal selecting one out of the first current detection signal and the second current detection signal is outputted, the failure determination element determines that there is a failure with a solenoid drive circuit corresponding to the other current detection signal when there is no change of the selection detection signal in a state where a selection command signal selecting the other one out of the first current detection signal and the second current detection signal is outputted.

With such a configuration, when the selection detection signal changes in the first direction during the specified period in a state where the selection command signal selecting one out of the first and second current detection signals is outputted, it is determined that there is a failure with a solenoid drive circuit corresponding to the other current detection signal when there is no change of the selection detection signal in a state where the selection command signal selecting the other one out of the first and second current detection signals is outputted. Therefore, a failure of the first solenoid drive circuit and a failure of the second solenoid drive circuit may be determined by discriminating these failures from each other.

Obviously, numerous modifications and variations of the present invention are possible in light of the above teachings. It is therefore to be understood that within the scope of the appended claims, the invention may be practiced otherwise than as specifically described herein.

What is claimed is:

1. A solenoid drive device comprising:

a first solenoid drive circuit including a first solenoid, a first switching element configured to perform duty control of an application voltage of the first solenoid, and a first current detection element configured to detect a first drive current supplied to the first solenoid;

a second solenoid drive circuit including a second solenoid, a second switching element configured to perform duty control of an application voltage of the second solenoid, and a second current detection element configured to detect a second drive current supplied to the second solenoid; and a control element configured to change the first drive current and the second drive current by performing on/off duty control of the first switching element and the second switching element, wherein the solenoid drive device includes a selection circuit configured to select either one of a first current detection signal outputted from the first current detection element and a second current detection signal outputted from the second current detection element, wherein the control element comprises:

a duty control element configured to supply a selection command signal selecting either one of the first current detection signal and the second current detection signal to the selection circuit, acquire values of the first drive current and the second drive current based on a selection detection signal outputted from the selection circuit, and perform the on/off duty control depending on the acquired values of the first drive current and the second drive current; and a failure determination element configured to perform failure determination with the selection circuit, the first solenoid drive circuit, and the second solenoid drive circuit as determination targets based on change characteristics of the selection detection signal, wherein the duty control element performs the on/off duty control of the first switching element in the same control cycle as on/off duty control of the second switching element, and sets on/off switching direction of the first switching element at a start time of one control cycle and on/off switching direction of the second switching element reversely from each other, the on/off switching direction including a switching direction from on to off and a switching direction from off to on, and wherein the failure determination element performs the failure determination based on change characteristics of the selection detection signal in a specified period when on/off states of the first switching element and the second switching element are different from each other.

2. The solenoid drive device according to claim 1, wherein when the selection detection signal changes in a first direction within the specified period in a state where a selection command signal selecting one out of the first current detection signal and the second current detection signal is outputted, the failure determination element:

determines that the determination target is normal when the selection detection signal changes in a second direction reverse to the first direction within the specified period in a state where a selection command signal selecting the other one out of the first current detection signal and the second current detection signal is outputted; and determines that the selection circuit sticks to the one when the selection detection signal changes in the first direction.

3. The solenoid drive device according to claim 1, wherein when the selection detection signal changes in a first direction within the specified period in a state where a selection command signal selecting one out of the first current detection signal and the second current detection signal is outputted, the failure determination element determines that there is a failure with a solenoid drive circuit corresponding to the other current detection signal when there is no change of the selection detection signal in a state where a selection command signal selecting the other one out of the first current detection signal and the second current detection signal is outputted.

4. A solenoid drive device comprising:

a first solenoid drive circuit comprising:

a first solenoid;

a first switching element to control a first application voltage applied to the first solenoid; and a first current detection element to detect a first drive current supplied to the first solenoid and to output a first current detection signal;

a second solenoid drive circuit comprising:

a second solenoid;

a second switching element to control a second application voltage applied to the second solenoid; and a second current detection element to detect a second drive current supplied to the second solenoid and to output a second current detection signal;

a selection circuit connected to the first current detection element and the second current detection element; and circuitry configured to output a selection command signal to the selection circuit to select either one of the first current detection signal and the second current detection signal so as to output a selection detection signal, acquire values of the first drive current and the second drive current based on the selection detection signal, and control the first switching element and the second switching element with a duty control to control the first drive current and the second drive current in a control cycle according to the acquired values of the first drive current and the second drive current so that a first on/off switching direction of the first switching element at a start timing of the control cycle is opposite to a second on/off switching direction of the second switching element at the start timing, the first on/off switching direction and the second on/off switching direction including a switching direction from on to off and a switching direction from off to on, and determine whether a failure in at least one of the selector, the first solenoid drive circuit, and the second solenoid drive circuit occurs based on a change in the selection detection signal in a period during which an on/off state of the first switching element is different form an on/off state of the second switching element.

5. The solenoid drive device according to claim 4, wherein when the selection detection signal changes in a first direction within the period in a state where the selection command signal selecting one out of the first current detection signal and the second current detection signal is outputted, the circuitry is configured to determine that a determination target in which the failure occurs is normal when the selection detection signal changes in a second direction reverse to the first direction within the period in a state where the selection command signal selecting the other one out of the first current detection signal and the second current detection signal is outputted; and determine that the selection circuit sticks to the one when the selection detection signal changes in the first direction.

6. The solenoid drive device according to claim 4, wherein when the selection detection signal changes in a first direction within the period in a state where the selection command signal selecting one out of the first current detection signal and the second current detection signal is outputted, the circuitry is configured to determine that there is the failure in the first solenoid drive circuit or the second solenoid drive circuit corresponding to an another current detection signal when there is no change of the selection detection signal in a state where the selection command signal selecting the other one out of the first current detection signal and the second current detection signal is outputted.

* * * * *